United States Patent [19]

Schuegraf

[11] 4,168,478

[45] Sep. 18, 1979

[54] APPARATUS FOR SEPARATING ELECTRICAL SIGNALS OF DIFFERENT FREQUENCIES

[75] Inventor: Eberhard Schuegraf, Munich, Fed. Rep. of Germany

[73] Assignee: Siemens Aktiengesellschaft, Berlin & Munich, Fed. Rep. of Germany

[21] Appl. No.: 878,279

[22] Filed: Feb. 16, 1978

[30] Foreign Application Priority Data

Feb. 25, 1977 [DE] Fed. Rep. of Germany ..... 2708306

[51] Int. Cl.[2] ..... H01P 5/12

[52] U.S. Cl. ..... 333/135; 333/230; 333/208

[58] Field of Search ..... 333/6, 9, 73 W

[56] References Cited

U.S. PATENT DOCUMENTS 3,978,434 8/1976 Morz et al. ..... 333/6

FOREIGN PATENT DOCUMENTS 1264636 3/1968 Fed. Rep. of Germany ..... 333/6

*Primary Examiner*—Eugene R. La Roche

*Assistant Examiner*—Robert E. Wise

*Attorney, Agent, or Firm*—Hill, Van Santen, Steadman, Chiara & Simpson

[57] ABSTRACT

Apparatus for separating electrical signals of different frequencies comprising two adjoining waveguides wherein both of the signals to be separated exist in one waveguide and only the higher frequency signal exists in the second waveguide including a radial circuit supressor attached to the first waveguide and with an extending center conductor extending through an opening formed in the first waveguide at a spacing of approximately one-quarter wavelength of the lower frequency band and wherein the center conductor of the radial circuit suppressor extends into the first waveguide a distance of approximately one-quarter wavelength for the center frequency of the higher frequency signal. A modification of the invention provides for a resonant cavity attached to the first waveguide with a longitudinal slot formed between the first waveguide and the resonant cavity and a third modification utilizes an inductive diaphragm rather than a slot formed between the resonant cavity and the first waveguide.

10 Claims, 3 Drawing Figures

APPARATUS FOR SEPARATING ELECTRICAL SIGNALS OF DIFFERENT FREQUENCIES

BACKGROUND OF THE INVENTION

1. Field of the Invention

This invention relates in general to a frequency separator device so as to separate two bands of signals having different frequencies and wherein both bands exist in a first waveguide segment and a second waveguide where only the higher frequency band exists and having at least one selective decoupling device for receiving the lower frequency band.

2. Description of the Prior Art

Satellite radio operations are an important utilization for frequency separators and, for example, it is known in U.S. Pat. No. 3,978,434 to utilize frequency separators in which the available transmitter and receiver frequency bands are to be separated under high decoupling requirements. However, the disadvantages in an arrangement such as disclosed in U.S. Pat. No. 3,978,434, is that two symmetrical couplings are required for each of the $H_{11}$ polarization signals so as to avoid the formation of undesired $E_{01}$ waves in the circular waveguide. Also, due to the absence of any right angle coupling, undesirable longitudinal components of the electric field intensity are excited with additional $E_{01}$ and $E_{11}$ components at the conically extending transition points between the first and second circular waveguide segments.

A filter comprising a radial circuit suppressor is also known in German Offenlegungsschrift 1,264,636, which may be used as a selective decoupling device for one of the frequency bands to be separated and the separator is designed with an extending inner conductor.

SUMMARY OF THE INVENTION

The present invention has the underlying objective to solve the previously mentioned difficulties in a relatively simple manner. The present invention eliminates relatively expensive symmetry coupling as required in the prior art and also the interfering excitation of waves with electric longitudinal components is prevented in the waveguide section.

The objects of the invention are accomplished by utilizing a frequency separator so as to separate two different frequency bands and the invention comprises a first hollow waveguide segment in which the two frequency bands are transmitted and a second hollow waveguide segment which is attached to the first hollow waveguide segment and in the second segment only the upper frequency band is transmitted. At least one selective decoupling device for the lower frequency band is also utilized and both of the hollow waveguide segments are designed so as to have different cross-sectional dimensions and a radial circuit suppressor having an extending inner conductor is provided as the decoupling device which blocks the upper frequency band, the extending inner conductor extends into the first waveguide at a position which is spaced a distance of approximately one-quarter wavelength of the center frequency of the lower frequency band from the effective short circuit plane of the junction occurring between the first and second waveguide segments and the inner conductor extends through an opening formed in the first waveguide wall.

The invention utilizes the knowledge that the cutoff frequency of the $E_{11}$ wave in a rectangular hollow waveguide having a sidewall ratio of b:a of approximately 1:2 is considerably greater than the cutoff frequency of one of the $E_{11}$ waves which correspond to the $E_{01}$ wave in a circular hollow waveguide and, thus, a second coupling is not required so as to suppress the $E_{11}$ wave in a rectangular hollow waveguide as is required, for example, in U.S. Pat. No. 3,978,434.

It is thus advantageous that the extending inner conductor of the radial circuit suppressor is mounted a distance of approximately one-quarter wavelength at a frequency of the lower frequency band from the effective short circuit plane of the cross-section defining the junction between the first and second waveguides and, thus, in the first maximum of the electric field intensity.

A further development of the inventive concept relating to high output loading capacity lies in the fact that the first hollow waveguide segment is connected to a third rectangular hollow wavegude segment through a coupling opening and that the radial circuit suppressor is coupled to the third hollow waveguide segment.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
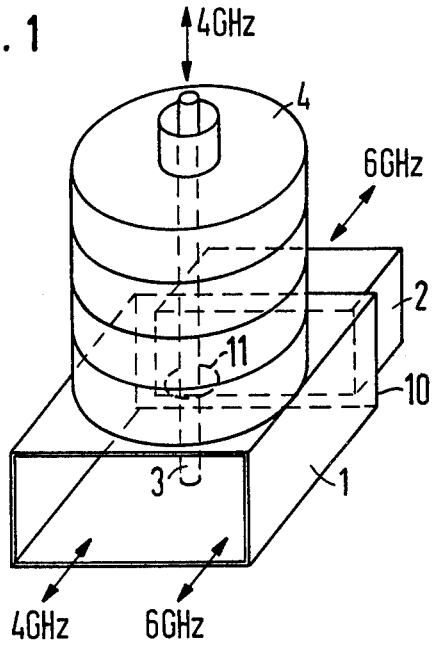
FIG. 1 illustrates a sample embodiment of the invention using a frequency separator.

FIG. 1 illustrates a frequency separator which by way of example is designed to separate 4 and 6 GHz frequency bands for satellite radio systems. Two hollow rectangular waveguide segments 1 and 2 are joined end to end as shown and a connecting wall 10 extends from the larger waveguide 1 to the outer wall of the smaller waveguide 2. The ratios of the walls of the waveguides 1 and 2 may be in the ration of b:a of approximately 1:2. The first hollow waveguide segment 1 in which both of the frequency bands exists feeds into the second hollow waveguide segment 2 of smaller cross-section in all dimensions which is axially connected to the end of the first waveguide segment and in the second waveguide segment 2 only the higher frequency band of 6 GHz exists. The transition 10 between the two hollow waveguide segments may be accomplished as shown in FIG. 1 by an abrupt step but such transition can also be carried out in stages or in a smooth transition so as to be low in reflection at the upper frequency band.

At a distance of approximately one-quarter wavelength of the center frequency of the lower frequency band from the short circuiting plane 10 forming the cross-sectional coupling between the waveguides 1 and 2 an inner conductor 3 of a radial circuit suppressor 4 extends into the waveguide 1 through an opening 11 formed in the upper wall of the waveguide 1. The radial circuit suppressor 4 is mounted on the broad side of the first hollow waveguide segment 1. By utilizing the spacing at the one-quarter wavelength of the lower frequency, the capacitive coupling or decoupling respectively proceeds by means of the extending inner conductor 3 of the radial circuit suppressor 4 in the first maximum of the electric field intensity thereby resulting in optimum coupling. This coupling is supported by the stationary wave before the transition to the continuing 6 GHz hollow waveguide 2 in the upper frequency band. In the selection of the spacing of the inner conductor 3 it is to be noted that the location of the effective short circuit plane of the cross-section transition 10 depends upon the cross-sectional ratio a:b of both hollow waveguide segments 1 and 2 and is due to the periodic attenuation of the lower frequency band in the hollow waveguide section 2 which is formed behind the cross-sectional transition 10 at a small distance. An additional improvement of the selection results when the spacing between one short circuit plane of the radial circuit suppressor 4 known per se and not illustrated in FIG. 1 provides for the upper frequency band and the distance of insertion of the extending inner conductor 3 into the first hollow waveguide segment 1 is approximately equal to a length of one-quarter wavelength of the frequency of the upper frequency band.

Figure 2:
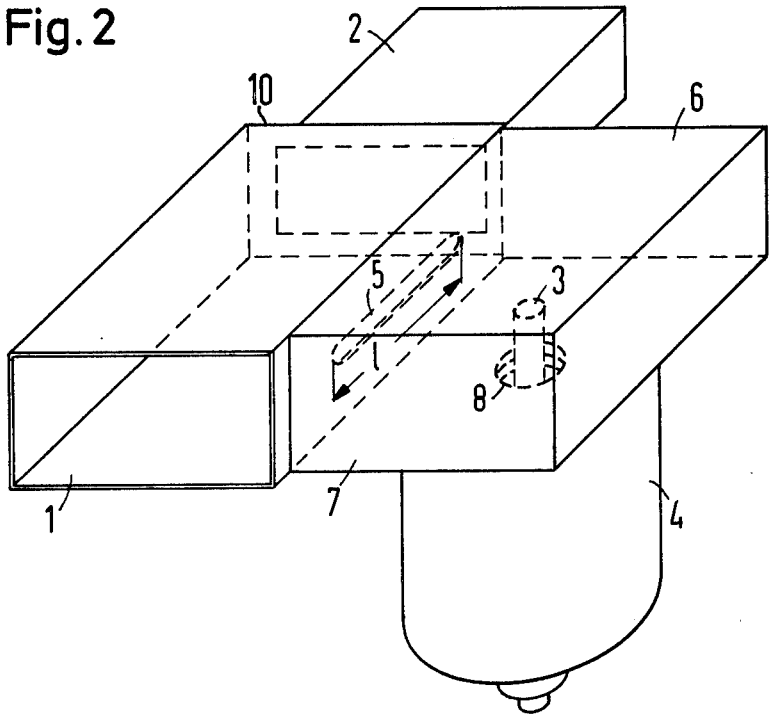
FIG. 2 illustrates a modified form of the invention including a frequency separator having a higher output loading capacity.

FIG. 2 illustrates a sample embodiment which is particularly suited for high continuous output in both the high and low frequency ranges and wherein the 6 GHz passes as in FIG. 1 from the waveguide segment 1 into the waveguide segment 2 and the 4 GHz signal passes from the waveguide segment 1 but is blocked off by the transition gap 10 between the waveguide segments 1 and 2. A third hollow waveguide segment 6 is coupled by a frequency selective coupling slot 5 which extends through the sidewalls of the waveguide segment 1 and the waveguide segment 6 as shown. As shown in FIG. 2, the waveguide segment 6 is connected with its narrow side connected to the narrow side of the first hollow waveguide segment 1 or they may in fact be constructed with a common sidewall. The resonant slot 5 is formed in the narrow side of the hollow waveguides 1 and 6 so as to couple the longitudinal magnetic fields $H_z$ and is thereby tuned to the center frequency of the lower frequency range, for example, 4 GHz at the sample frequencies used above. The length of the resonant slot 5 is approximately equal to a one-half wavelength in free space at the resonant frequency, for example, 4 GHz. Also, the center of the resonant slot is spaced from the short circuit plane 10 of the cross-section transition of one-quarter wavelength at the low frequency band so that at resonance the total 4 GHz energy band passes through the slot 5 from the waveguide segment 1 into the waveguide segment 6, and the $H_{20}$ cutoff frequency of the hollow waveguide segment 6 can advantageously be selected to be above the highest frequency of the 6 GHz range. Care must be taken, however, that a sufficiently low frequency $H_{10}$ border frequency results. The hollow waveguide segments 6 and/or 1 can, if desired be constructed as hollow ridge waveguides so as to broaden the available defined range.

The decoupling of the 4 GHz range in the embodiment illustrated in FIG. 2 is accomplished in a manner similar to that in FIG. 1 however, such separation is not accomplished in the hollow waveguide 1 but rather through a coupling opening 8 formed in the additional hollow waveguide segment 6 into which the extending inner conductor 3 of a radial circuit suppressor 4 is inserted. Thus, a complete coupling of the radial circuit suppressor 4 to the hollow waveguide segment 6 is obtained. The correpondingly strong coupling of the resonant slot 5 is accomplished through the magnetic longitudinal component $H_z$ at both sides of the joint hollow waveguide wall. As the component $H_z$ with a constant output and an increased frequency drops by a factor of $$\lambda_0/4\sqrt{1-(\lambda_0/\lambda_k)^2}$$

and as the intensity of the coupling of the coupling element is dependent upon the product of the coupling field intensities at both sides of the coupling element one obtains a value for the decoupling of both frequency ranges with the magnetic longitudinal components selected as the coupling field intensities. The radial circuit suppressor 4 supplies an additional essential portion of the decoupling so as to decouple the two frequency ranges. Due to the preselection of the remaining portion of the arrangement, the isolation caused by the radial circuit suppressor 4 is lower for a specific decoupling requirement in the embodiment illustrated in FIG. 2 than it is in the embodiment illustrated in FIG. 1. As the radial circuit suppressor 4 provides the main filter separation for the selection between the two frequency bands it is not necessarily required that the resonant slot 5 be formed as a very narrow slot. It can for example, have a width of 10% of the hollow waveguide height or may be have a greater width. Design data indicating dimensioning of the cross-sectional dimensions and the wall length of the rectangular resonant slot relative to the resonant position and band width can be obtained from pages 320 and 321 of the book entitled "Handbood of High Frequency Technique" by Minke, Gundlach, published by the Springer Company in 1962, second edition.

An additional portion of the preselection results in that a stationary wave occurs in the joint hollow waveguide 1 having a maximum for the coupling of the longitudinal field intensity $H_z$ at the location of the resonant slot 5 and only a continuous wave exists for the 6 GHz range due to the adjustment in the hollow waveguide segment 2. This transition from the stationary wave to the continuous wave at the location of the resonant slot is related to a decline of the magnetic field intensity $H_z$ for the 6 GHz range by approximately 6 dB relative to frequency in the 4 GHz range and, therefore, results in a corresponding increase of the preselection. The resonant slot 5 supplies a third factor due to its resonant selectivity as explained above. If the selection characteristics of the resonant slot is ignored due to the large band width in a sample embodiment the arrangement according to FIG. 2 without radial circuit suppressor at frequencies for example between the 4 and 6 GHz range has a decoupling of at least 11, or 6 dB. In other words, at an output of, for example, of 5 kW only 346 watts will be available in the hollow waveguide 6 and, thus, the hollow waveguide 6 provides for decoupling the 4 GHz range in a simple manner from the hollow waveguide 6 as shown in FIG. 2 with the aid of the extending inner conductor 3 of the radial circuit suppressor 4. The breakdown resistance of the device illustrated in FIGS. 1 and 2 can be increased even greater by providing that the ends of the inner guide 3 be formed into a ball shape probe if desired.

In the embodiment illustrated in FIG. 2, the length of the hollow waveguide segment 6 can be made minimal relative to the longitudinally extending direction of the waveguide 1 and the capacity probe 3 can be spaced a quarter wave length at the higher frequency from the short circuit plate 7 as described relative to FIG. 1. The probe 3 may be spaced from the resonant slot 5 of a quarter wavelength at the lower frequency. The length of the short circuit plate 7 may be a half wavelength at the lower frequency. The capacitive probe 3 thus lies in the same cross-section as the center of the resonant slot. The hollow waveguide segment 6 however in the sample embodiment illustrated in FIG. 2 need not necessarily be tuned as a resonator for the lower frequency range of 4 GHz due to the strong coupling caused by the capacitive probe 3 projecting relatively far into the interior of the hollow waveguide and also due to the very strongly coupling resonant slot 5. The length of the slot 5 is indicated by the dimension 1 and may be one half wavelength.

In the embodiment illustrated in FIG. 2, the coupling between the hollow waveguide 1 and the hollow waveguide 6 provides a complete energy transit in the desired frequency range of, for example, 4 GHz. On the other hand, the operation is fundamentally altered when the coupling element does not couple as strongly and the complete energy transfer is effected in that with one coupling element within one resonator interactions with additional coupling points will result.

Figure 3:
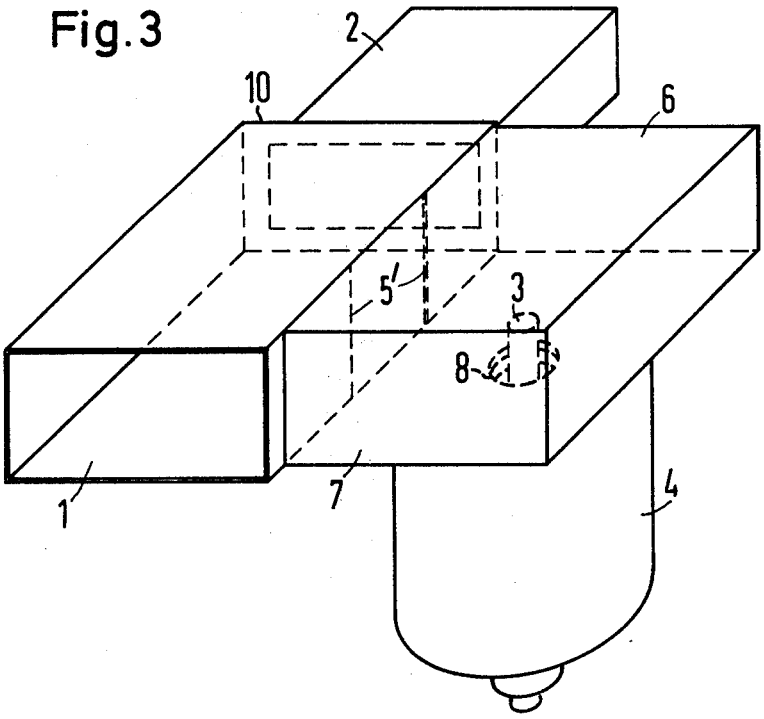
FIG. 3 illustrates a further embodiment of the invention utilizing a frequency selector.

An embodiment illustrated in FIG. 3 is similar to the arrangement illustrated in FIG. 2 except the slot 5 has been replaced with an inductive diaphragm 5' between the waveguide segments 1 and 6. The hollow waveguide segments 1, 2 and 6 and the radial circuit suppressor 4 have the same arrangements in FIG. 3 as in FIG. 2 and the hollow waveguide segment 6 is constructed as a 4 GHz resonator which is also coupled to the joint hollow waveguide 1 with the $H_2$ component, however, the inductive diaphragm 5' is mounted in the narrow side of the first hollow waveguides segment 1 rather than the resonant slot used in FIG. 2. The diaphragm 5' has a certain coupling attenuation which becomes larger as the cross-sectional area of the diaphragm 5 is decreased. The decoupling from the resonator 6 is accomplished with the extended inner conductor 3 of the radial circuit suppressor 4 which may in the embodiment of FIG. 3 be inserted less deeply into the resonator 6 because of the requirement that the lower coupling exists in the separator arrangement of FIG. 3 than that of FIG. 2.

A complete energy transfer for example occurs in the 4 GHz range when the resonator 3 length is adjusted to the desired frequency range and is equal to an integral multiple of the hollow waveguide wave length at the 4 GHz frequency. Since the inductive diaphragm 5' by itself does not facilitate a complete energy transfer in the 4 GHz range the diaphragm also supplies a higher portion for the preselection than the resonant slot according to FIG. 2 in the 6 GHz frequency band which is to be decoupled. Thus, an additional amount of the preselection is accomplished due to the selectivity of the resonator 6 in the embodiment of FIG. 3.

It is advantageous to provide the inductive coupling 5' with dimensions as small as possible in the direction of the resonator 6 longitudinal axis so that the resonant frequency of the diaphragm 5' will lie far above the 6 GHz frequency range. So as to obtain a sufficient intensity of the desired coupling in the 4 GHz range, the coupling opening as illustrated in FIG. 3 is formed to have maximum height and as shown in the embodiment illustrated in FIG. 3 the height is selected to be equal to the height of the resonator hollow waveguides 1 and 6.

The separator behaves according to FIG. 3 in the 6 GHz attenuation band and is essentially determined by the position of the higher resonances of the resonator and at what amplitudes they are being propagated. When the inductive coupling diaphragm 5' is mounted in the center of the narrow longitudinal resonator side of the hollow waveguide resonator 6 which is expedient for optimum coupling of the $H_{101}$ base resonance at 4 GHz, no $H_{10m}$ resonances with integral multiples of $\lambda_H/2$ (m straight) can be excited. In this case, for example, the $H_{102}$ resonance cannot be excited because it does not exhibit a $H_z$ component in the center of the diaphragm and its $H_z$ component always have the same size to the right and left of the partial cross-section of the diaphragm, however, they are in the opposite directions. Thus, the first excitable interference resonance is the $H_{103}$ resonance which is positioned by means of a suitable resonator dimensioning such that this resonance does not fall into the 6 GHz range.

So as to limit the resonator 6 to the type of $H_{10x}$ resonances, it is desirable to put the $H_{20}$ cutoff frequency of the hollow waveguide resonator 6 above the highest frequency of the 6 GHz range. The interval between the $H_{10}$ and the $H_{20}$ cutoff frequency of a rectangular hollow waveguide can be considerably increased by using a ridge hollow waveguide instead of waveguides as illustrated in FIGS. 2 and 3.

The field distribution provided in the 6 GHz suppression band in the resonator can advantageously be utilized in order to produce an attenuation pole at 6 GHz in that the 4 GHz probe decoupling is mounted to a resonator cross-section at which a zero point of the electric residual field intensity occurs at the center of the 6 GHz frequency band. Due to the broad maximum of the electric field intensity at the $H_{101}$ base resonance, the coupling intensity of the capacitive probe is only decreased slightly if it is displaced from the center of the resonator in the longitudinal direction. Also, the loss in coupling intensity for a greater displacement can be compensated for by inserting the probe 3 a greater insertion depth into the resonator 6.

Additional hollow space resonators can also be coupled to the first resonator instead of the radial circuit suppressors so as to obtain total decoupling. It is also possible that the arrangements illustrated in FIGS. 2 and 3 can be provided with compensation circuits such as disclosed, for example, in the book entitled "Theory of High Frequency Circuits" by H. Meinke, published by Oldenburg of Munich, Germany in 1951 and particularly on pages 96 and 219 through 225. Such compensation circuits produce a counter current frequency path of the reflection factor relative to the separator arrangement provided and, thus, provide an additional improvement of the transmitting behavior of the separator in the lower frequency band and also provide an additional increase in selectivity.

Although the apparatus has been described with respect to preferred embodiments it is not to be so limited as changes and modifications may be made which are within the full intended scope as defined by the appended claims.

I claim as my invention:

1. A frequency separator for separating two frequency bands, consisting of a first hollow waveguide segment in which said two frequency bands exist, a second hollow waveguide segment connected to said first hollow waveguide segment and only the higher frequency band exists in said second waveguide segment and at least one decoupling device for receiving the lower frequency band, wherein said first and second hollow waveguide segments (1, 2) are designed as rectangular hollow waveguides of different cross-sectional dimensions, a radial circuit suppressor (4) coupled to said first waveguide segment and blocking the higher frequency band and having an extending inner conductor (3) as a decoupling device, and said extending internal conductor (3) is mounted at a distance of approximately $\lambda_H/4$ from the effective short circuit plane of the cross section junction occurring between the first and second hollow waveguide segments and said internal conductor extending through an opening of the wall of said first hollow waveguide segment (1) and whereby $\lambda_H$ is a frequency within the lower frequency band.

2. A frequency separator in accordance with claim 1, wherein the effective short circuit plane of the radial circuit suppressor (4) and the opening of the wall of the first hollow waveguide segment (1) is approximately $\lambda_H/4$, whereby $\lambda_H$ is a frequency within the lower frequency band.

3. A frequency separator according to claim 2, wherein said first hollow waveguide segment (1) is connected to a third rectangular hollow waveguide segment (6) through a coupling opening (5, 5'), and wherein the radial circuit suppressor (4) is coupled to said third hollow waveguide segment (6).

4. A frequency separator according to claim 3, wherein said coupling opening is designed as a frequency selective resonance slot (5) which is tuned to pass frequencies contained in the lower frequency band.

5. A frequency separator according to claim 4, wherein said resonance slot (5) is provided for the coupling of the magnetic longitudinal fields $H_z$ at the narrow sides of the first hollow waveguide segment (1) and of the third hollow waveguide segment (6), and wherein the length of the slot (5) is equal to one half wavelength of the free space wavelength $\lambda_o$ of a frequency of the lower frequency band.

6. A frequency separator according to claim 3, wherein said coupling opening comprises an inductive diaphragm (5').

7. A frequency separator according to claim 6, wherein said inductive diaphragm (5') is provided for the coupling of the magnetic longitudinal fields $H_z$ at the narrow sides of the first and third hollow waveguide segments (1, 6).

8. A frequency separator according to claim 3 wherein the length of said third hollow waveguide segment (6) is selected such that said third segment comprises a resonator for frequencies in the lower frequency band.

9. A frequency separator according to claim 5 wherein the center of said coupling opening (5, 5') is spaced from the effective short circuit plane of the transition point between said first hollow waveguide segment (1) and said second hollow waveguide segment (2) by a distance of one quarter wave length of a frequency in the lower frequency band.

10. A frequency separator according to claim 1 wherein compensation circuits are provided which exhibit a wide band counter current frequency characteristic relative to the frequency characteristic of the reflection factor of said separator.

* * * * *